US009528254B2

(12) United States Patent
Kuang

(10) Patent No.: US 9,528,254 B2
(45) Date of Patent: Dec. 27, 2016

(54) INJECTION MEMBER ASSEMBLY

(75) Inventor: Qifeng Kuang, Shanghai (CN)

(73) Assignee: SHANGHAI KOHLER ELECTRONICS, LTD. (CN)

( * ) Notice: Subject to any disclaimer, the term of this patent is extended or adjusted under 35 U.S.C. 154(b) by 541 days.

(21) Appl. No.: 13/473,505

(22) Filed: May 16, 2012

(65) Prior Publication Data

US 2012/0284912 A1 Nov. 15, 2012

Related U.S. Application Data

(63) Continuation-in-part of application No. PCT/CN2010/078803, filed on Nov. 16, 2010.

(30) Foreign Application Priority Data

Nov. 17, 2009 (CN) ..... 2009 1 1000217

(51) Int. Cl.
*A47K 3/26* (2006.01)
*E03D 9/08* (2006.01)

(52) U.S. Cl.
CPC ..... *E03D 9/08* (2013.01)

(58) Field of Classification Search
CPC ..... E03D 9/08
USPC ..... 4/420.4, 420.3, 443–445, 447, 448
See application file for complete search history.

(56) References Cited

U.S. PATENT DOCUMENTS 4,028,745 A 6/1977 Caniglia
4,094,018 A * 6/1978 Bemthin ..... 4/420.4
4,558,473 A 12/1985 Morikawa et al.
4,704,748 A * 11/1987 Takeda ..... E03D 9/08 4/420.4
5,050,249 A * 9/1991 Takeda et al. ..... 4/443
5,159,722 A * 11/1992 Diethelm ..... E03D 9/08 4/420.4
5,960,484 A * 10/1999 Shao ..... E03D 9/08 4/420.4
6,754,912 B1 * 6/2004 Hayashi ..... E03D 9/08 239/468
6,782,562 B1 8/2004 Aono
6,959,459 B2 11/2005 Takenaga
9,096,997 B2 * 8/2015 Mochita ..... E03D 9/08
2006/0070173 A1 * 4/2006 Yoon ..... 4/420.4

(Continued)

FOREIGN PATENT DOCUMENTS

CN 2307054 2/1999
CN 2313982 4/1999

(Continued)

OTHER PUBLICATIONS

Japanese Application No. 2012-538185 Office Action mailed Jul. 30, 2013.

(Continued)

*Primary Examiner* — Paul R Durand
*Assistant Examiner* — Nicholas Ros
(74) *Attorney, Agent, or Firm* — Foley & Lardner LLP

(57) ABSTRACT

An injection member assembly (30) for a bidet includes a movable injection member (40) and a bracket (82) provided with a guiding surface (84) and a driving assembly (60). The driving assembly (60) includes a driving device (62) and a coupling member (64) coupled with the guiding surface (84), and the movable injection member (40) is connected to at least one of the driving assembly (60) and the bracket (82).

20 Claims, 9 Drawing Sheets

(56) References Cited

U.S. PATENT DOCUMENTS

| | | | | |
|---|---|---|---|---|
| 2007/0175530 | A1* | 8/2007 | Vilhelmsen | E03C 1/0404 137/801 |
| 2009/0313752 | A1* | 12/2009 | Kunimoto | E03D 9/08 4/662 |
| 2011/0113540 | A1* | 5/2011 | Plate | E03D 1/01 4/300 |

FOREIGN PATENT DOCUMENTS

| | | | | |
|---|---|---|---|---|
| CN | 2542753 | | 4/2003 | |
| CN | 2719955 | | 8/2005 | |
| CN | 2751083 | | 1/2006 | |
| CN | 1997798 | | 7/2007 | |
| CN | 2007/10199074 | | 12/2007 | |
| CN | 201148662 | | 11/2008 | |
| JP | 60-080170 | | 6/1985 | |
| JP | 60-151978 | | 10/1985 | |
| JP | 61-137244 | | 6/1986 | |
| JP | 61-239620 | | 10/1986 | |
| JP | S63-113537 | | 5/1988 | |
| JP | S63-300134 | | 12/1988 | |
| JP | 02-144748 | | 6/1990 | |
| JP | H2-274930 | | 11/1990 | |
| JP | 03-240472 | | 10/1991 | |
| JP | 06-146376 | | 5/1994 | |
| JP | 06-038945 | | 10/1994 | |
| JP | 08027864 | | 1/1996 | |
| JP | 08302794 | | 11/1996 | |
| JP | 2000-80707 | | 3/2000 | |
| JP | 2003-147839 | | 5/2003 | |
| JP | 2006-104924 | | 4/2006 | |
| JP | 2006/125193 | | 5/2006 | |
| JP | 2007-205141 | | 8/2007 | |
| JP | 2007/205141 | | 8/2007 | |
| JP | WO2007139163 | * | 12/2007 | E03D 9/08 |
| KR | 2002-0064688 | | 8/2002 | |
| TW | 331346 | | 5/1998 | |
| TW | 331347 | | 5/1998 | |
| TW | 1322213 | | 3/2010 | |
| WO | WO00/29681 | | 5/2000 | |
| WO | WO2006/079232 | | 8/2006 | |
| WO | WO 2007/091691 | | 8/2007 | |
| WO | WO 2009/092205 | | 7/2009 | |

OTHER PUBLICATIONS

Search Report in related Taiwan Application No. 099139103.

Japanese Office Action with English Translation dated Jul. 8, 2014 for Application No. 2012-538184, 8 pages.

Office Action in related Japanese Application No. 2012-538184 mailing date Jul. 30, 2013.

First Office Action in related Chinese Application No. 200911000217.8 issuing date Jun. 26, 2013.

KIPO Notice of Preliminary Rejection dtd Apr. 10, 2014 for Application No. 10-2012-7014723, 6 pages.

Notification Concerning Transmittal of International Preliminary Report on Patentability (Chapter 1 of The Patent Cooperation Treaty) in PCT/CN2010/078803.

Second Chinese Official Action App. No. 200911000217.8 issued Jan. 28, 2014.

Supplementary Partial European Search Report issued May 10, 2016.

* cited by examiner

INJECTION MEMBER ASSEMBLY

CROSS-REFERENCE TO RELATED PATENT APPLICATIONS

This application is a continuation in part of International Application PCT/CN2010/078803, filed Nov. 16, 2010, incorporated herein by reference in its entirety, which claims priority from Chinese Application No. 200911000217.8, filed Nov. 17, 2009, incorporated herein by reference in its entirety.

FIELD OF THE INVENTION

The present invention relates to an injection member assembly for a bidet or bidet toilet. The injection member assembly includes an injection member, a driving assembly and a bracket assembly. Said injection member assembly has the advantage of maximal stability in operation, allowing the injection member to extend out and retract without jittering or slipping.

BACKGROUND OF THE INVENTION

Conventional injection assemblies for bidets can suffer from jittering or slipping.

The prior art includes U.S. Pat. No. 5,050,249. Such prior art relates to a kind of human private parts washing apparatus. Said washing apparatus is provided with a washing nozzle which can extend out and retract. A movable rack is formed by a partial segment of the washing nozzle, a fixed rack formed on the surface of the nozzle supporter, and a pinion meshing with the movable rack and the fixed rack. The pinion meshing with the fixed rack is driven to rotate by a motor, enabling the washing nozzle to move. Another scheme is disclosed in U.S. Pat. No. 6,782,562, which relates to a toilet seat with a washing machine which is provided with a movable injection pipe. In this patent, a drive rack positioned on an injection arm engages with a secondary pinion and a drive rack positioned on an operation device engages with a primary pinion. An interlocking mechanism connects a counter rotation pinion and the secondary pinion while the counter rotation pinion meshes with the primary pinion. This patent discloses a means of manually pushing or pulling the operation device to cause the pinion to rotate, resulting in the extension and retraction of the injection pipe.

Another body washing unit for a flush toilet is disclosed in U.S. Pat. No. 6,959,459, wherein a first tube is rotatably connected with a second tube which is further rotatably connected with a third tube. A driving device rotates the second tube to displace the third tube angularly around the axis of the second tube. A converter converts rotational motion of the second tube into rotational motion of the third tube around its axis so that the nozzle arranged on the third tube moves between a standby position and a usage position. This patent describes the automatic operation of the nozzle after a user switches on the equipment.

Other prior art examples include: 1). WIPO Patent Application No. WO/2006/079232, wherein a shower arm for a shower toilet is disclosed. Said shower arm is socketed to a guide tube and can protrude out from such guide tube. Said tube is further socketed to a guide bush and can extend out from such guide bush. A flexible tape is connected with the shower arm. When a pinion is driven by a motor, the flexible tape, meshing with the pinion through such tape's dentate surface, starts moving. This movement leads to the extension and retraction of said shower arm and said tube. 2). Japanese Patent Application No. 2006-125193, wherein a washing toilet seat with a drying function is disclosed. In this example, a drive mechanism partially meshes with the surface of the bent drying nozzle, which is moved between its housed position and the position where the reciprocating movement is operated. Pressurized air generated in such movement is injected to the user's intended body part.

The present method aims to solve the problems of the prior art and to provide unprecedented improvements.

SUMMARY OF THE INVENTION

In accordance with one embodiment or aspect of the present invention, an injection member assembly is provided. The injection member assembly includes an injection member, a driving assembly and a bracket assembly. The injection member is capable of extending and retracting. For example, the bended bidet wand in the retracted position is housed and extends into the bidet bowl area, so as to spray liquid and (or) air onto the user's body.

In accordance with another embodiment or aspect of the present invention, the injection member is connected to at least one of the driving assembly and the bracket assembly. When the injection member extends or retracts, the injection member moves along with the driving assembly and/or the bracket assembly. In an embodiment where the driving assembly or the bracket assembly is immovably fixed, a more compact and durable assembly can be obtained.

In accordance with another embodiment or aspect of the present invention, the driving assembly is coupled with the incurved inner surface of the bracket assembly. The size and shape of the bracket assembly are designed to be able to house the injection member in the retracted position. The driving assembly is coupled with the incurved inner surface of the bracket assembly. This minimizes the slipping and jittering of the driving assembly, allowing the injection member assembly to slide smoothly.

The objective in at least one of the embodiments of such invention is to provide an injection assembly including a movable injection member, a bracket provided with a guiding surface, and a driving assembly further including a driving device and a coupling member, wherein said coupling member is coupled with the guiding surface and the movable injection member is connected to at least one of the driving assembly and the bracket.

In some embodiments of the present invention, the injection member is fixedly connected with the driving assembly. In other embodiments of the present invention, the injection member is fixedly connected with the bracket. In yet other embodiments, the type of driving device can vary in terms of different situations, taking the form of an electric motor, an actuator or a manual operation drive.

In some embodiments of the present invention, the coupling member is a pinion. In other embodiments of the present invention, the coupling member is a pin. In some embodiments of the present invention, the guiding surface is in arcuate (i.e., curved) form. In other embodiments of the present invention, the guiding surface is in a tooth form. In some embodiments of the present invention, the guiding surface is an incurved rack. In other embodiments of the present invention, the guiding surface is an incurved slot. The guiding surface may be substantially rigid.

In some embodiments of the present invention, the bidet is fixedly connected to at least one of the driving assembly and the bracket. The injection member is characterized with an arch form. In other embodiments of the present invention, the injection member is an arcuate (i.e., curved) bidet wand, which may include a liquid injection outlet and an air outlet.

DETAILED DESCRIPTION OF THE PREFERRED EMBODIMENTS

Figure 1:
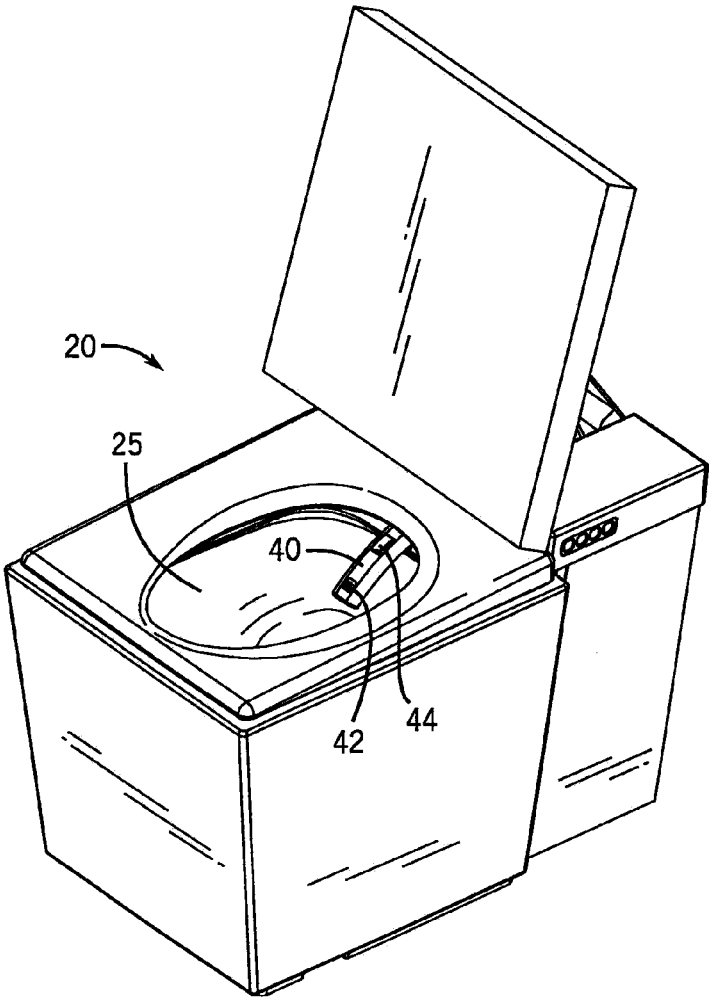
FIG. 1 is a perspective view of one embodiment of the bidet in the present invention.
Figure 2:
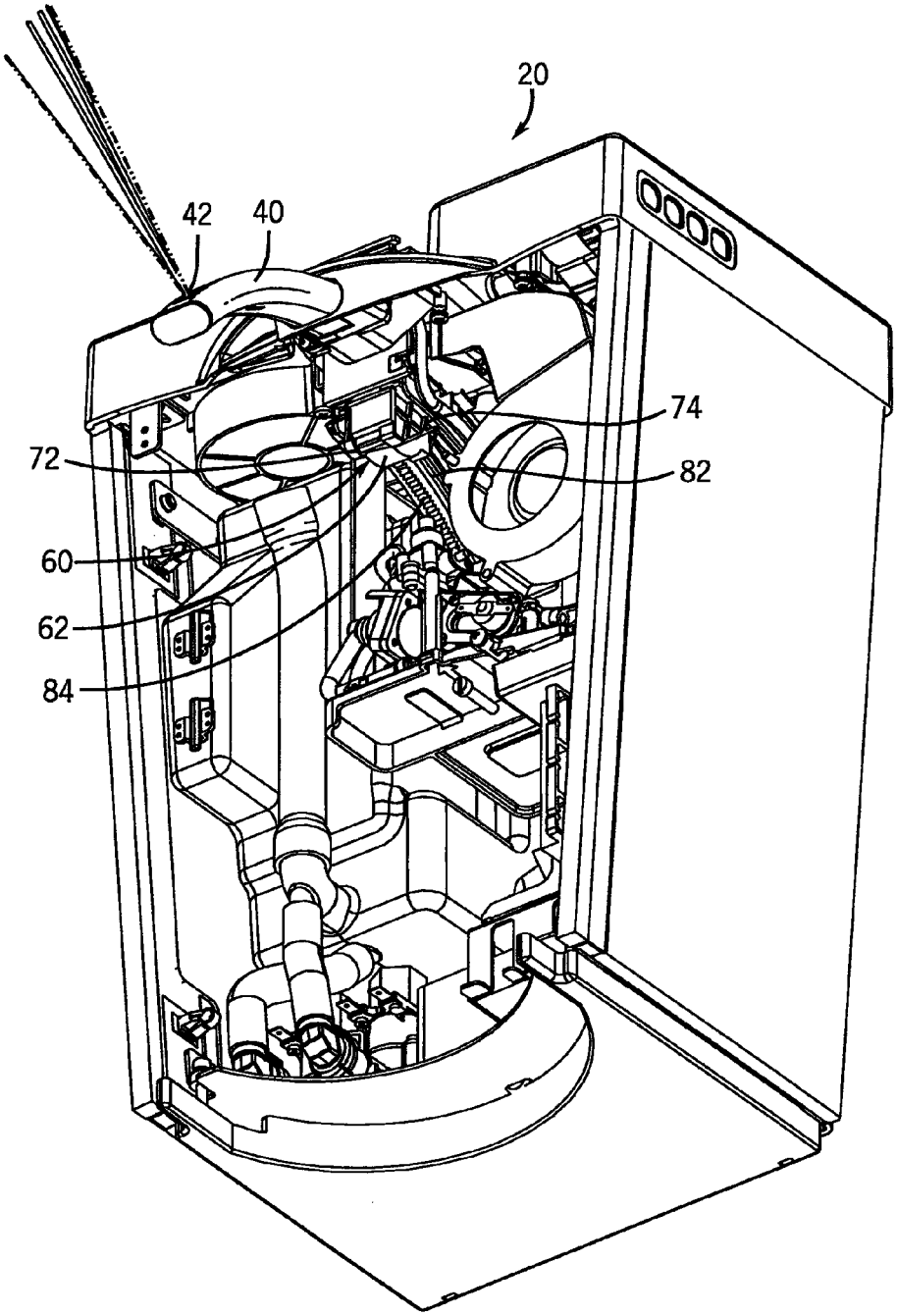
FIG. 2 is a partial perspective view of the bidet as illustrated in FIG. 1.
Figure 3:
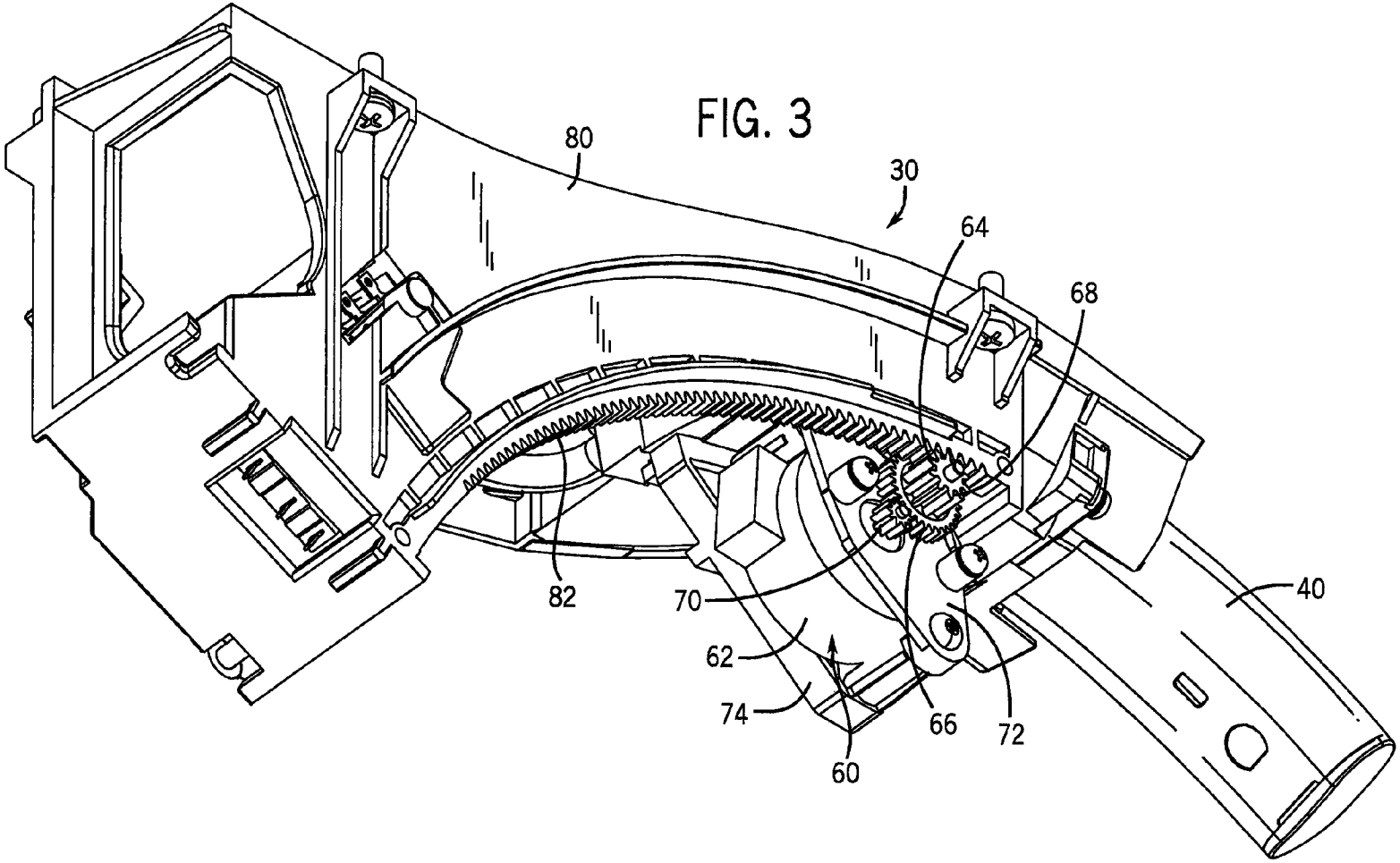
FIG. 3 is a perspective view of the injection member assembly, which is illustrated with an injection member in an extended position.
Figure 4:
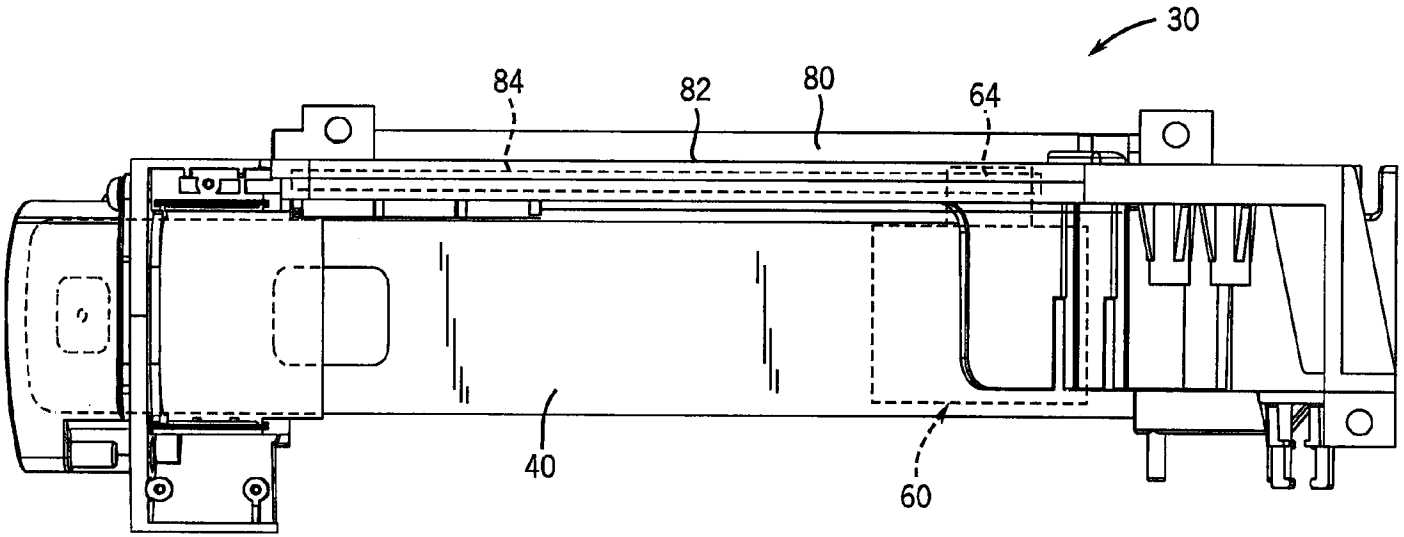
FIG. 4 is a plan view of the injection member assembly as illustrated in FIG. 3; such injection member assembly is illustrated with the injection member in a refracted position.
Figure 5:
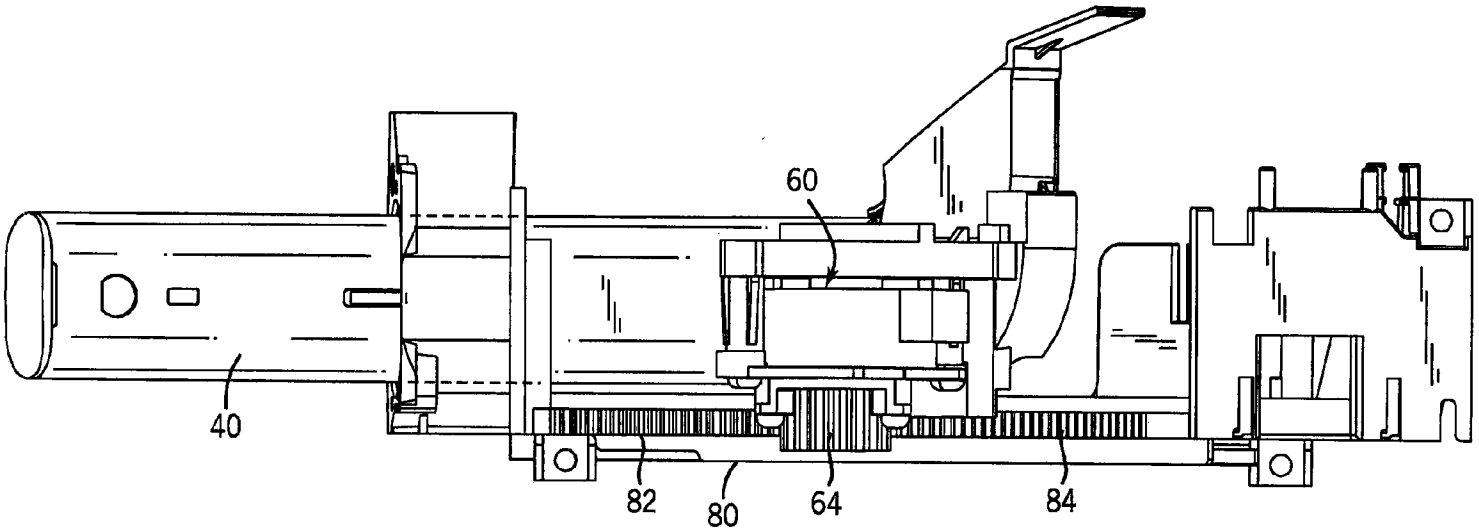
FIG. 5 is an upward (i.e., looking up from below) view of the injection member assembly as illustrated in FIG. 3; such injection member assembly is illustrated with an injection member in a partially extended position.

FIGS. 1 and 2 illustrate an embodiment of a bidet 20. FIGS. 3-5 illustrate an embodiment of an injection member assembly 30. The injection member assembly 30 includes an injection member 40, a driving assembly 60 and a bracket assembly 80. The injection member 40 installed in the injection member assembly 30 can extend and retract. For example, the injection member 40 can extend out when the bidet 20 is used and retract into a retracted position for storage when unneeded.

In the embodiment illustrated, the injection member 40 includes two independent openings, a liquid outlet 42 and an air outlet 44. Optionally, the injection member 40 can be provided with only a single liquid outlet or a single air outlet. In other embodiments, the liquid outlet and the air outlet may share the same opening. The liquid outlet 42 is used for spraying liquid. For instance, clean water sprays out of the liquid outlet 42 onto certain parts of a user body (not displayed) in or on the bidet 20. The air outlet 44 provides gas (e.g., air) flow. Warm flowing air may jet from the air outlet 44 onto certain parts of a user body in the bidet 20. In the embodiments illustrated here, the injection member 40 is fixedly connected to the driving assembly 60. Optionally, the injection member 40 can also be fixedly connected to the bracket assembly 80. In accordance with different needs, the injection member 40 can take different sizes and shapes. For example, the injection member can be in arcuate form (i.e., curved) or straight form. In the illustrated embodiments, the injection member 40 is arcuate (i.e., curved) protruding upwardly seen from longitudinal view, allowing a more compact bidet shell.

As illustrated in FIG. 3, the driving assembly 60 includes a driving device 62 and a coupling member 64. The driving device 62 used for moving the injection member 40 can be any type of drive (e.g., that conforms to relevant industrial standards), such as a motor, an actuator or a manual operation drive like a crank, a lever or a free handle. The driving device 62 as illustrated in the embodiment of FIG. 3 is a motor. The coupling member 64 coupled with the bracket assembly 80 can be in the form of a gear, an axle or a pin. In the embodiment as illustrated in FIG. 3, the coupling member 64 is a gear assembly, including a base gear 66 and a coupling gear 68. The driving device 62 further includes a driving gear 70, which is coupled with the base gear 66, and the coupling gear 68 is coupled with the bracket assembly 80. Optionally, the coupling member 64 can be the driving gear 70, wherein the bracket assembly 80 is coupled with said driving gear 70. In the embodiment as illustrated in FIG. 3, the driving device 62 and the coupling member 64 are positioned on the driving bracket 72. The mounting bracket 74 connects the driving assembly 60 to the injection member 40. In addition, the driving assembly 60 can also be connected to the injection member 40 through the shell, hull or the driving bracket 72.

Figure 6:
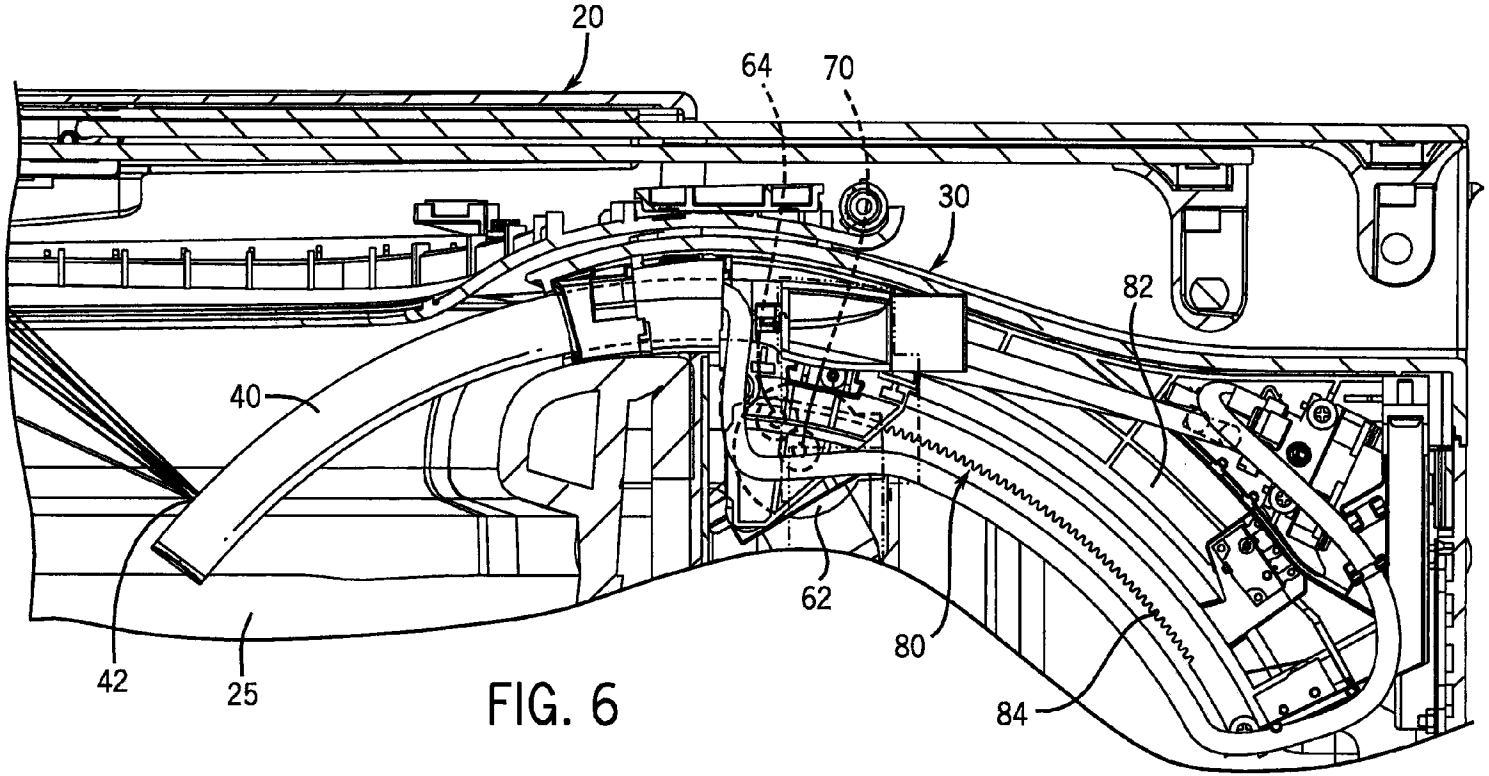
FIG. 6 is a partial sectional view of the bidet provided with the injection member assembly as illustrated in FIG. 3 with fully extended position.
Figure 7:
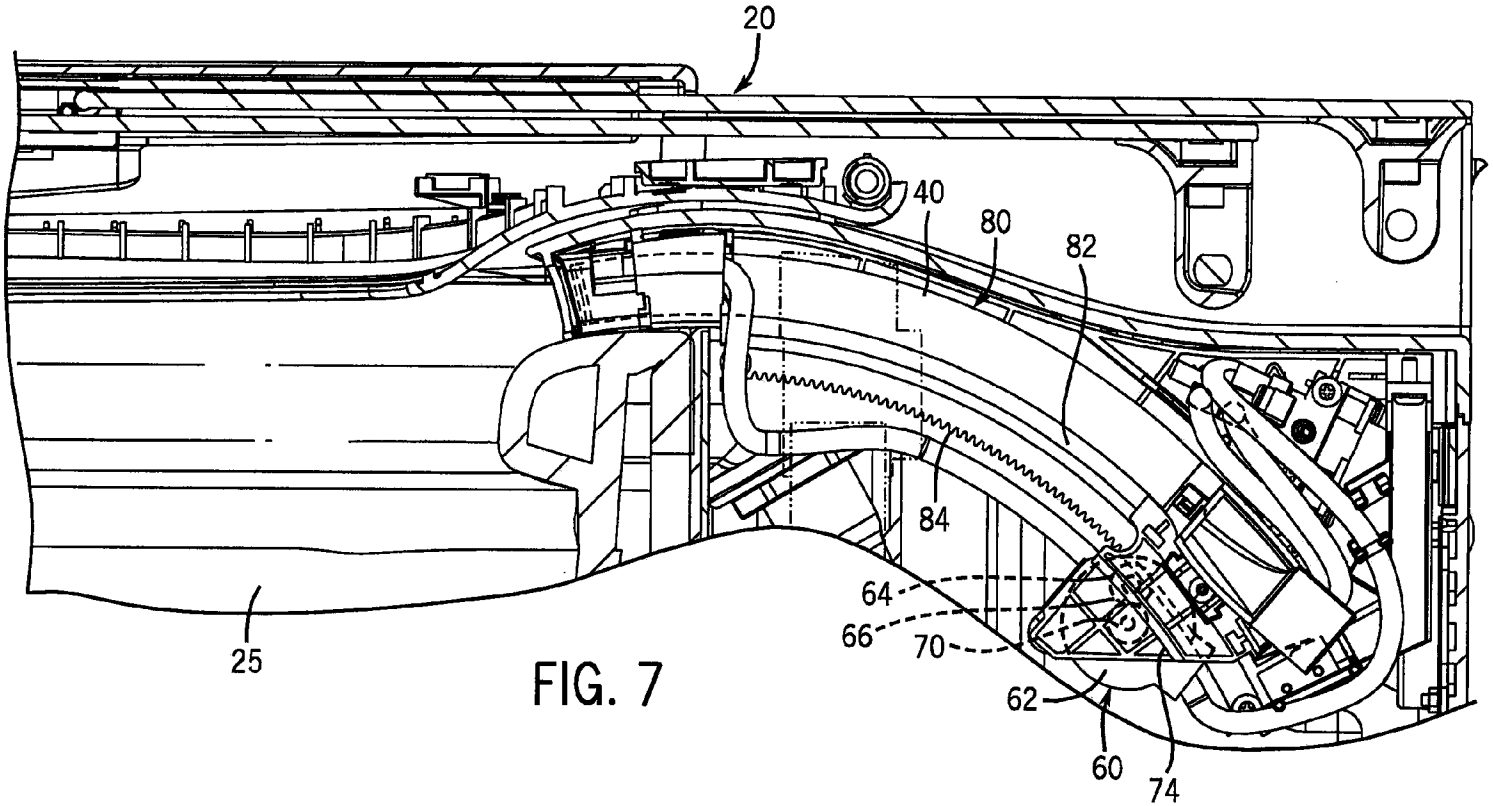
FIG. 7 is a partial sectional view of the bidet provided with the injection member assembly as illustrated in FIG. 3 with fully retracted position.

The bracket assembly 80 includes a bracket 82 and a guiding surface 84 (e.g., as labeled in FIGS. 5-7). The bracket assembly 80 can be fixedly connected to another bracket or the bidet wall. In an embodiment where the bracket assembly 80 is attached to the bidet wall, the bracket assembly 80 is fixedly connected with the bidet 20. In other embodiments, the bracket assembly 80 can be movable, and the driving assembly 60 can be fixedly connected with the bidet 20. The size and shape of the bracket assembly 80 are structured to be able to at least partially house the injection member 40 when it is in a fully retracted position, as displayed in FIG. 4. In some embodiments, the injection member 40 may be prevented from fully retracting by structuring the size and shape of the bracket assembly 80, or by fixedly connecting the injection member 40 to the driving assembly 60 or the bracket assembly 80 in an appropriate position. In the embodiment illustrated in FIG. 4, the bracket assembly 80 is provided with a guiding surface 84 coupled (e.g., for movement) with the coupling member 64. In varying embodiments, the guiding surface 84 can be the whole surface formed on the bracket 82, provided on bracket parts connected to the bracket 82, or provided on the pathway of the bracket 82 such as a slot or a groove. In varying embodiments, the guiding surface 84 can be dentate or smooth in terms of the shape. The guiding surface 84 in FIG. 3 (e.g., numbered in FIGS. 5-7) is a gear bar installed on the bracket 82.

In the embodiment described in FIG. 3, the driving gear 70 is made to turn by the driving device 62, leading to the rotation of the base gear 66 in a countervailing direction. The coupling gear 68 rotates in the same direction as the base gear 66. The coupling gear 68 is coupled with the dentate surface of the guiding surface 84, resulting in the movement of the coupling gear 68 along the guiding surface 84. The incurved segment of the guiding surface 84 contributes to the optimal engagement between the coupling gear 68 and the guiding surface 84, minimizing the jittering and slipping between the two.

In order to cause the injection member 40 to extend out from the retracted position as illustrated in FIG. 7, the driving device 62 can be started by a single signal source (not displayed) such as a controller, a button or a switch. The driving device 62 causes the coupling gear 68 to move along the guiding surface 84 towards the bowl 25 of the bidet 20. Since the driving device 62 is fixedly connected with the injection member 40, the injection member 40 will move along an arcuate (i.e., curved) path identical to the shape of the driving assembly 60, and extend out into the bowl 25.

When the injection member 40 is in a fully extended position as illustrated in FIG. 6, the driving device 62 stops. Optionally, the driving device 62 can stop at any point of the guiding surface 84, allowing a plurality of different extended positions of the injection member 40 in accordance with various needs. When the driving device 62 is started upon receiving a signal, the injection member 40 retracts, which causes the driving device 62 and the coupling gear 68 to rotate in a countervailing direction compared with the case in which the injection member 40 extends out. The coupling gear 68 moves along the guiding surface 84, gradually moving away from the bowl 25, which causes the injection member 40 to retract towards the bracket 82. When the injection member 40 is in a fully retracted position as illustrated in FIG. 7, the driving device 62 stops. The driving device 62 can optionally stop at any point of the guiding surface 84, allowing a plurality of different refracted positions of the injection member 40 in accordance with various needs.

Figure 8:
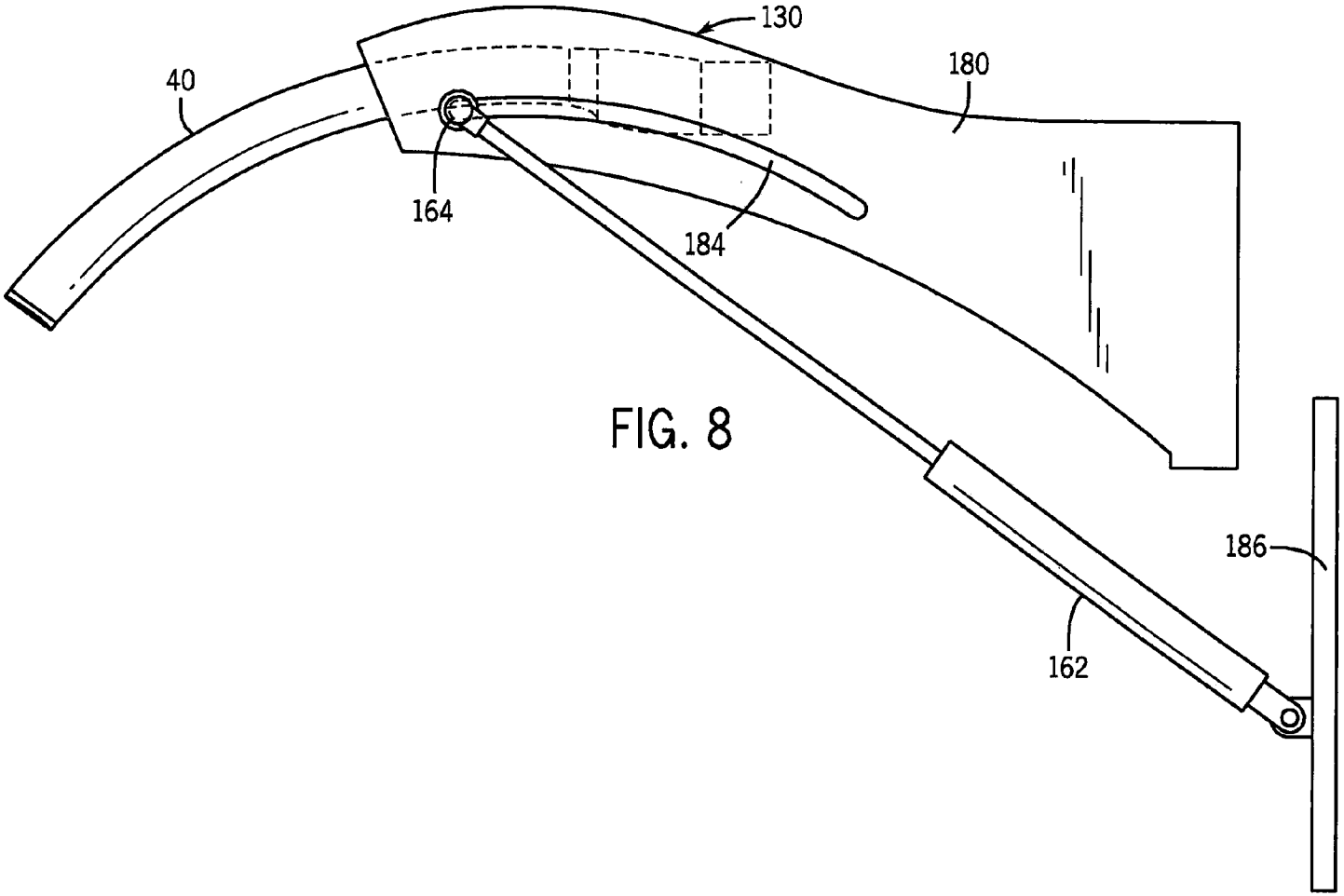
FIG. 8 describes another embodiment of the injection member assembly.

FIG. 8 illustrates another embodiment of the injection member assembly 130 (referring to the whole set), which is provided with an injection member 40 fixedly connected to the driving device 162 through the coupling member 164. The driving device 162 in this case is an actuator connected to the coupling member 164. The coupling member 164 is in the form of a pin installed in the guiding surface 184 which is coupled onto the bracket assembly 180. The driving device 162 is pivotally connected to a fixed surface 186 such as the bracket or the bidet shell.

Figure 9:
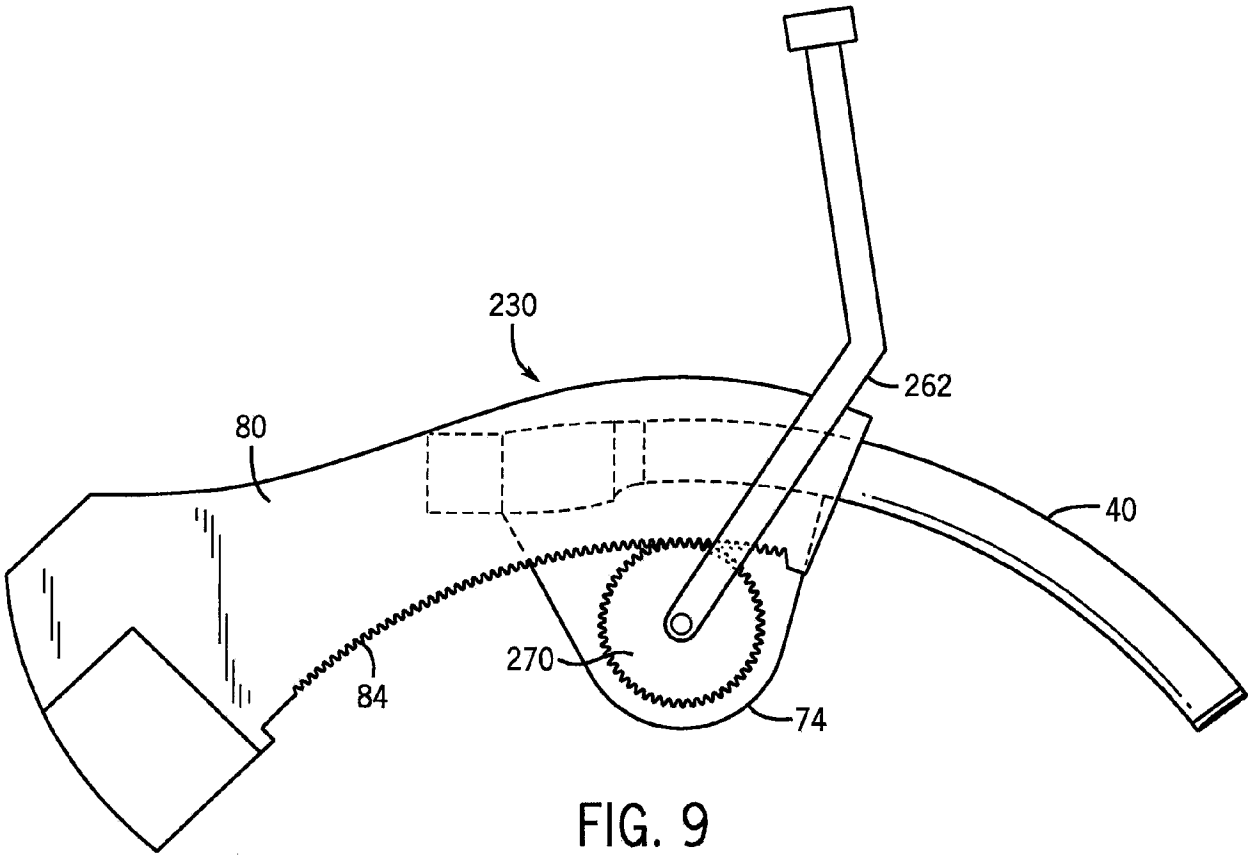
FIG. 9 describes another embodiment of the injection member assembly.

FIG. 9 illustrates another embodiment of the injection member assembly 230, which is provided with an injection member 40 fixedly connected to the driving device 262 through the mounting bracket 74. The driving device 262 in this case is a manual operation drive, such as a rotatable handle connected to the driving gear 270. The driving gear 270 is coupled with the guiding surface 84 of the bracket assembly 80. The driving device 262 can be manually rotated in one direction, causing the extension of the injection member 40, or in a countervailing direction, leading to the retraction of the injection member 40.

In some alternative embodiments, the injection member assembly can be provided with more than one injection member or driving device.

What is claimed is:

1. An injection member assembly for a bidet, comprising:
a movable injection member;
a bracket provided with a guiding surface; and
a driving assembly including a driving device and a coupling member, wherein the coupling member is coupled with the guiding surface and the driving device causes the coupling member to move along the guiding surface;
wherein the movable injection member is fixedly connected to the driving device, such that the driving device moves the same distance as the injection member as the coupling member moves along the guiding surface; and
wherein the driving device and the injection member move in the same direction, as the injection member is extended and retracted.

2. The injection member assembly of claim 1, wherein the bracket is stationary.

3. The injection member assembly of claim 1, wherein the driving device includes an actuator.

4. The injection member assembly of claim 1, wherein the driving device includes a manual operation drive.

5. The injection member assembly of claim 1, wherein the guiding surface is an incurved slot.

6. The injection member assembly of claim 1, wherein the bidet is fixedly connected to at least one of the driving assembly and the bracket.

7. The injection member assembly of claim 1, wherein the movable injection member has an arch form shape.

8. An injection member assembly for a bidet, comprising:
a movable injection member;
a bracket provided with a guiding surface; and
a driving assembly including a driving device and a coupling member, wherein the coupling member is coupled with the guiding surface and the driving device causes the coupling member to move along the guiding surface;
wherein the movable injection member is fixedly connected to the driving device, such that the driving device moves the same distance as the injection member as the coupling member moves along the guiding surface; and
wherein the driving device includes a motor.

9. The injection member assembly of claim 8, wherein the driving device and the injection member move in the same direction, as the injection member is extended and retracted.

10. The injection member assembly of claim 8, wherein the coupling member is a pin.

11. An injection member assembly for a bidet, comprising:
a movable injection member;
a bracket provided with a guiding surface; and
a driving assembly including a driving device and a coupling member, wherein the coupling member is coupled with the guiding surface and the driving device causes the coupling member to move along the guiding surface;
wherein the movable injection member is fixedly connected to the driving device, such that the driving device moves the same distance as the injection member as the coupling member moves along the guiding surface; and
wherein the coupling member is a gear.

12. The injection member assembly of claim 11, wherein the guiding surface has an arch form.

13. The injection member assembly of claim 11, wherein the movable injection member is an arcuate bidet wand further including a liquid injection outlet and an air outlet.

14. An injection member assembly for a bidet, comprising:
a movable injection member;
a bracket provided with a guiding surface; and
a driving assembly including a driving device and a coupling member, wherein the coupling member is coupled with the guiding surface and the driving device causes the coupling member to move along the guiding surface;
wherein the movable injection member is fixedly connected to the driving device, such that the driving device moves the same distance as the injection member as the coupling member moves along the guiding surface; and
wherein the guiding surface has a dentiform.

15. The injection member assembly of claim 14, wherein the movable injection member is an arcuate bidet wand.

16. An injection member assembly for a bidet, comprising:
a movable injection member;
a bracket provided with a guiding surface; and a driving assembly including a driving device and a coupling member, wherein the coupling member is coupled with the guiding surface and the driving device causes the coupling member to move along the guiding surface;

wherein the movable injection member is fixedly connected to the driving device, such that the driving device moves the same distance as the injection member as the coupling member moves along the guiding surface; and wherein the guiding surface is an incurved gear bar.

17. The injection member assembly of claim 16, wherein the guiding surface is rigid.

18. An injection member assembly for a bidet, comprising:

a movable injection member;

a stationary bracket assembly, the bracket assembly having a bracket and a guiding surface; and a driving assembly including a driving device, a driving gear, and a coupling gear, the driving device configured to rotate the coupling gear through the driving gear;

wherein the coupling gear is operatively coupled with the guiding surface through a gear mesh;

wherein the injection member is fixedly connected to the driving device; and wherein the driving device moves with the injection member the same amount of travel as the injection member is extended and retracted.

19. The injection member assembly of 18, wherein the driving assembly further comprises a base gear operatively coupled to the driving gear through a gear mesh and configured to rotate the coupling gear when rotated by the driving gear.

20. The injection member assembly of 19, wherein the driving gear is rotated by the driving device and drives rotation of the base gear in a countervailing direction relative to the driving gear, wherein the coupling gear rotates in the same direction as the base gear; and wherein the coupling gear is rotationally coupled with a dentate surface of the guiding surface to drive relative movement between the coupling gear and the bracket to move the injection member.

* * * * *